US005398751A

United States Patent [19]

Blomgren

[11] Patent Number: 5,398,751

[45] Date of Patent: Mar. 21, 1995

[54] PLATE HEAT EXCHANGER

[76] Inventor: Ralf Blomgren, Älgvägen 13, S230 10 Skanör, Sweden

[21] Appl. No.: 167,849

[22] PCT Filed: Jun. 18, 1992

[86] PCT No.: PCT/SE92/00442

§ 371 Date: Dec. 13, 1993

§ 102(e) Date: Dec. 13, 1993

[87] PCT Pub. No.: WO93/00563

PCT Pub. Date: Jan. 7, 1993

[30] Foreign Application Priority Data

Jun. 24, 1991 [SE] Sweden ..... 9101928

[51] Int. Cl.[6] ..... F28F 3/04

[52] U.S. Cl. ..... 165/166; 165/167

[58] Field of Search ..... 165/166, 167, 165

[56] References Cited

U.S. PATENT DOCUMENTS

| | | | |
|---|---|---|---|
| 2,940,736 | 6/1960 | Odman | 165/166 |
| 3,783,090 | 1/1974 | Andersson et al. | 165/166 |
| 4,781,248 | 11/1988 | Pfeiffer | 165/167 |
| 4,915,165 | 4/1990 | Dahlgren et al. | 165/166 |
| 4,966,227 | 10/1990 | Andersson | 165/167 |

FOREIGN PATENT DOCUMENTS

| | | |
|---|---|---|
| 443870 | 3/1986 | Sweden . |
| 458806 | 5/1989 | Sweden . |
| 1357282 | 6/1974 | United Kingdom . |

*Primary Examiner*—Martin P. Schwadron
*Assistant Examiner*—L. R. Leo
*Attorney, Agent, or Firm*—Davis Hoxie Faithfull & Hapgood

[57] ABSTRACT

A plate heat exchanger for heat transfer media, comprising a plurality of heat transfer plates having ridges (11) running adjacent each other, the top portions (13) of which are located on a specific distance from a plane parallel with the plate, and in an angle with these ridges, grooves (12) running adjacent to each other, the bottom portions (14) of which are located on an equal distance from said plane. Each plane portion located between two parallel ridges (11) and two parallel grooves (12), is provided with protrusions (18) and depressions (19), the top portions (20) and bottom portions (21) of which, respectively, are located closed to said plane than said specific distance. At least one of said plate portions (15) is provided with only two protrusions (18) formed in connection to each of said two grooves (12) and only two depressions (19) formed in connection to each of said two ridges (11), and a wall (22), which extends from the top portion (13) of the ridge to the bottom portion (21) of the depression and from the bottom portion (14) of the groove to the top portion (20) of the projection, respectively, shows a height which exceed said specific distance.

4 Claims, 2 Drawing Sheets

PLATE HEAT EXCHANGER

Figure 1:
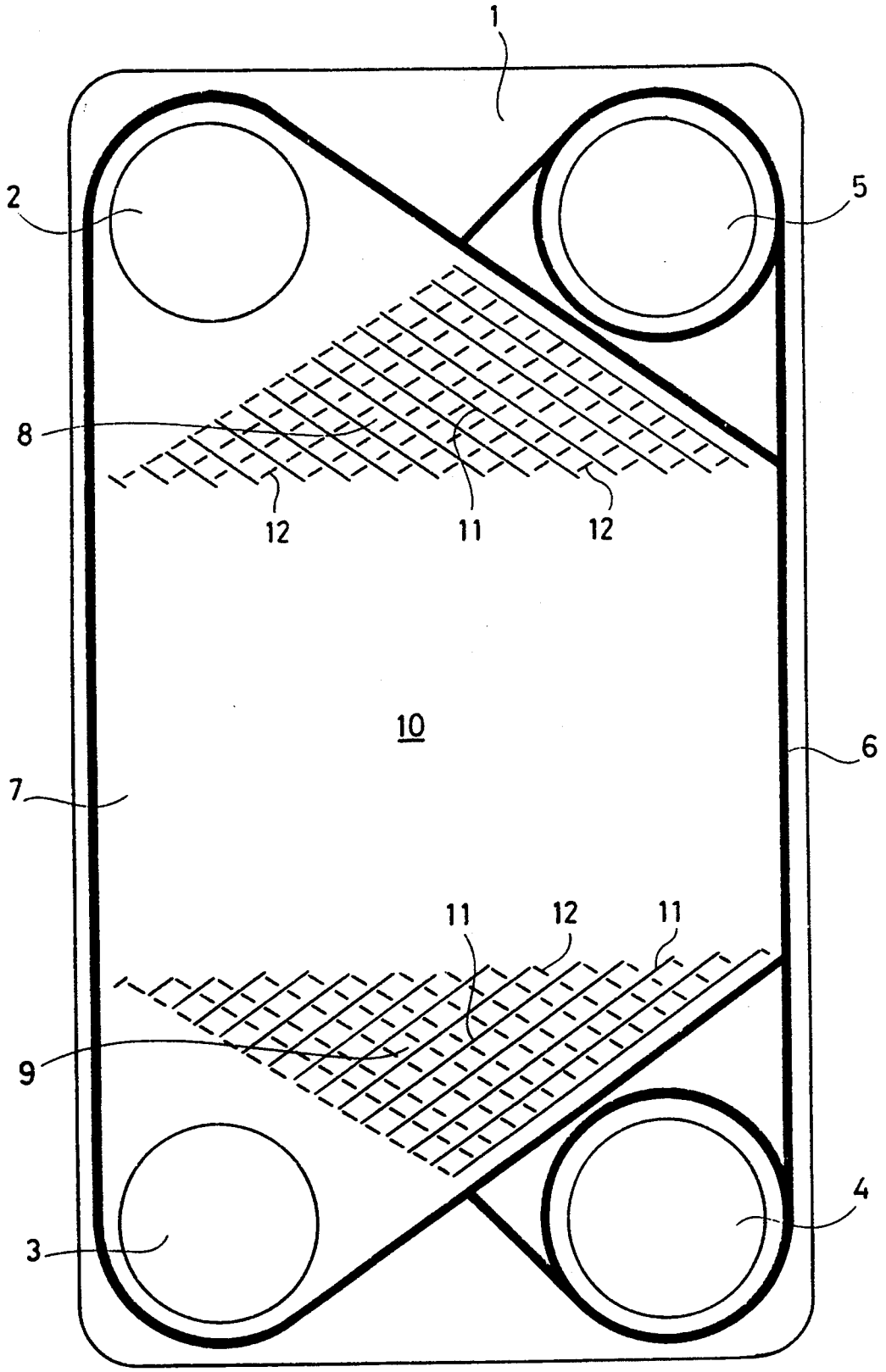

The present invention relates to a plate heat exchanger comprising several heat transfer plates, each of which has at least one heat transfer portion which has in part parallel ridges upwardly pressed to a specific distance from a plane parallel to the plate and at an angle against these downwards pressed parallel grooves, and in part intermediate plate portions, which are provided with protrusions and depressions, located at a distance from said plane less than said specific distance, the ridges on one side of a plate as well as the ridges on the other side of the plate, which latter ridges are formed by the grooves, together with the intermediate plate portions form passages, each of which intersects passages formed on the opposite side of the plate, and the ridges and the grooves are so arranged in two plates assembled adjacent each other in the plate heat exchanger that ridges on one of the plates abut against ridges running parallel therewith on the other plate.

Through GB 1357282 it is previously known to provide a heat transfer plate with a corrugation pattern of ridges running adjacent to each other, pressed upwardly from a plane parallel with the plate, and at an angle to these ridges, grooves running adjacent each other pressed downwardly from said plane. Ridges and grooves are thus formed on both sides of the plate, and the ridges together with intermediate plate portions form passages for heat transfer media. These passages extend in different directions on each side of the plate and when two plates are mounted adjacent each other the ridges on the one plate abut along the whole of the plate length against ridges running parallel with the ridges of the other plate.

It is also known from the above mentioned patent that the surfaces between the ridges and the grooves can be made more rigid by having bulges in one or the other direction or by being provided with irregularities. This has been used with heat transfer plates in which the plate portions between parallel ridges and parallel grooves have been relatively large, and the surfaces have been provided with a corrugation pattern in shape of parallel ridges and grooves pressed less deeply than the rest of the corrugation pattern of the plate. Also dot-shaped protrusions have been used to attain a contraction of either of the passages, so that the flow resistance has become larger for the heat transfer media flowing through the passage. An increased flow resistance leads to an improved heat transfer. Such protrusions have been located between two parallel ridges, but often the protrusions have not been given sufficient width to attain a thermally efficient contraction, since the ridges which are directed in the same direction as the protrusions in such case should have been weakened.

Hitherto it has thus been difficult to attain thermally efficient protrusions of the above described kind. This applies mainly to plates which have a small distance between the parallel ridges and to plates which have a small pressing depth. As the area between two ridges is located in an intermediate plane only half of the pressing depth can be utilized to obtain the protrusions. For plates with a small pressing depth it will then be difficult to attain a sufficiently well defined corrugation pattern, and shaping of the plates in a previously known manner will lead to a mechanical weakening of the corrugation pattern of the plates.

The object of the present invention is to attain an increased flow resistance for both of the heat transfer media in a plate heat exchanger of the kind described and to mechanically strengthen the corrugation pattern of the heat transfer plates of the plate heat exchanger.

These objects are achieved according to the invention with a plate heat exchanger of the above described kind which is characterized in that at least one of said intermediate plate portions, located between two parallel ridges and two parallel grooves, is provided with only two protrusions connected to each of said two grooves and only two depressions connected to each of said two ridges, and that each ridge and the depression connected thereto, and each groove and the protrusion connected thereto, respectively, each comprises one part of a common wall, which extends from a top portion of the ridge to a bottom portion of the depression, and from a bottom portion of the groove to a top portion of the protrusion, respectively and at least two of the walls opposite each other in the same intermediate plate portion have a height which exceeds said specific distance.

Through the present invention the local pressing depth adjacent the ridges and the grooves is increased which gives a clearer defined corrugation pattern and leads to an increase in the bending strength of the ridges and the grooves. In addition, a contraction of the passages on both sides of the heat transfer plate is provided.

Figure 2:
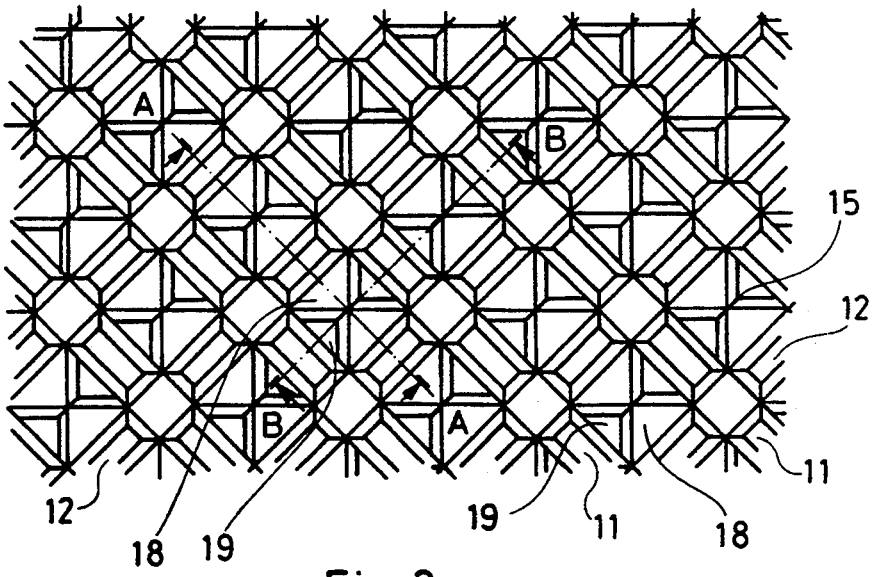
Figure 3:
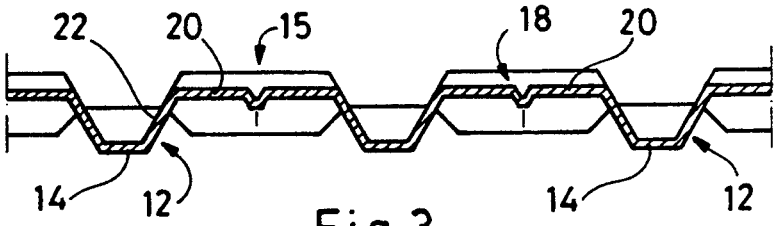
Figure 4:
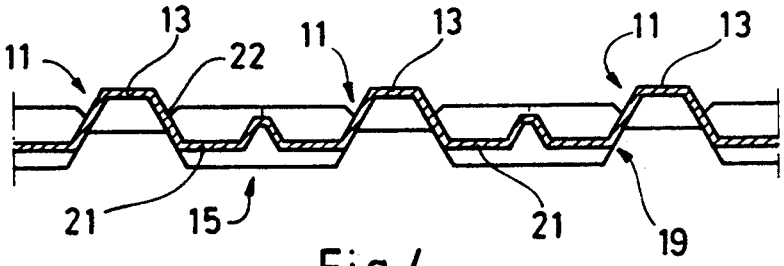
Figure 5:
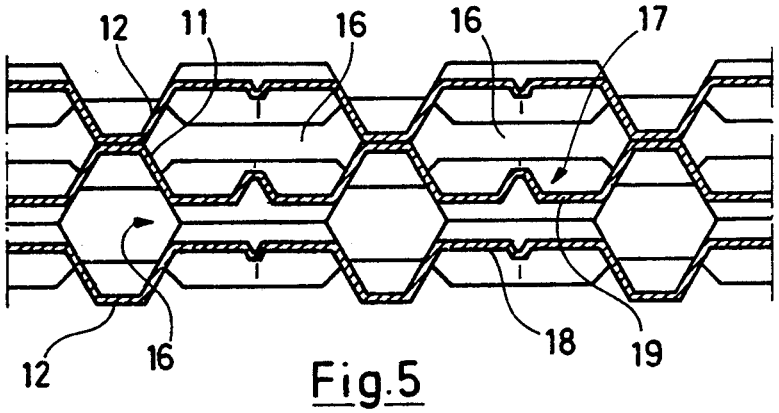

The invention will be described in more in detail with reference to the accompanying drawings, in which FIG. 1 shows a schematic view of a heat transfer plate, FIG. 2 shows a part of a heat transfer plate with a corrugation pattern formed in accordance with the invention, FIG. 3 shows a cross-section along the line A—A in FIG. 2, FIG. 4 shows a cross-section along the line B—B in FIG. 2, and FIG. 5 shows a cross-section through three heat transfer plates abutting one another.

The present plate heat exchanger is meant for two heat transfer media and comprises several heat transfer plates of thin sheet or the like, which through pressing have been provided with a corrugation pattern.

In FIG. 1 there is shown a heat transfer plate 1 corrugated to a specific pressing depth, which in a conventional manner is provided with an inlet opening 2 and an outlet opening 3, for a first heat transfer medium, and an inlet opening 4 and an outlet opening 5, for another heat transfer medium. A seal 6 extends around the openings 4 and 5 and around the periphery of the plate, which seal 6 together with an additional heat transfer plate delimit a flow space 7 for one of said heat transfer media and passages for through-flow of the other heat transfer medium.

The heat transfer plate 1 has pressing been provided with a corrugation pattern and with several heat transfer portions located between the inlet opening 2 and the outlet opening 3, such as an upper distribution surface 8 and a lower distribution surface 9, and a main heat transfer surface 10 located between the distribution surfaces 8 and 9. The distribution surfaces 8 and 9 have a corrugation pattern of upwardly pressed parallel ridges 11 and at an angle thereto downwardly pressed grooves 12. The corrugation pattern for the main heat transfer surface 10 has not been shown in the drawing but this surface could also be provided with a corresponding corrugation pattern.

In a plate heat exchanger comprising a stack of several heat transfer plates 1, one of two adjacent heat transfer plates is rotated 180° in its own plane relative to the other plate. By this means the ridges 11 on one of the heat transfer plates will abut against the ridges, formed by the grooves 12, on the other heat transfer plate, and in which ridges abutting against each other extend in parallel. Between two such arranged heat transfer plates parallel flow passages are formed by the ridges abutting against each other.

In FIGS. 2–5 there is clearly shown how the corrugation pattern for at least one heat transfer portion is formed. The corrugation pattern has several ridges 11, running adjacent each other, the top portions 13 of which are pressed upwardly a specific distance, corresponding to half of the pressing depth, from an intermediate plane parallel to the plate, and at an angle with these ridges, grooves 12 running adjacent each other, the bottom portions 14 of which are pressed downwardly half of the pressing depth and thus are located at an equal distance from the central plane.

The areas of the heat transfer plate which are located at the crossing points between the ridges 11 and the grooves 12, are located in a plane between the top portions of the ridges 11 and the bottom portions of the grooves 12. However, alternatively, as is indicated in FIG. 1, the ridges 11 may extend continuously while the grooves 12 extend with a break across the ridges 11.

The ridges 11 on one side of the plate and the grooves 12 formed by the ridges on the other side of the plate together with intermediate plate portions 15 form passages 16 for the heat transfer media. Each of these passages intersects passages formed on the opposite side of the plate.

The plate portions 15 in the bottom 17 of the passages are provided with protrusions 18 and depressions 19, the top portions 20 and bottom portions 21 of which, respectively, are located at a distance from said intermediate plane which is less than half of the pressing depth.

The ridges 11 and the grooves 12 are so arranged in two plates assembled adjacent each other in the plate heat exchanger, that ridges on one of the plates abut against ridges on the other plate running parallel with the same.

According to the invention at least one of said plate portions 15, which is located between two parallel ridges 11 and two parallel grooves 12, is provided with only two protrusions 18 designed in connection with each of said two grooves 12 and only two depressions 19 designed in connection with each of said two ridges 11.

In addition each ridge 11 and the depression 19 connected thereto, and each groove 12 and the protrusion 18 connected thereto, respectively, each comprises a part of a common wall 22, which extends from the top portion 13 of the ridge to the bottom portion 21 of the depression, and from the bottom portion 14 of the groove to the top portion 20 of the projection, respectively.

Preferably each such wall 22 has a height which exceeds half of the pressing depth, providing a contraction of the passages 16 on both sides of the heat transfer plates 1. In heat transfer plates meant for unsymmetrical flow, i.e. heat transfer between two fluids of which one has a considerably larger flow than the other, it can however happen that only two opposite walls 22 within the same plate portion 15 have a height which is larger than half of the pressing depth.

Preferably, each of said protrusions 18 and depressions 19 extend along essentially the whole length of the groove and the ridge, respectively, at the plate portion 15, but naturally a protrusion or a depression may extend along only a part of the plate portion 15 when its size permits it.

The protrusions 18 and depressions 19 are preferably symmetrically located in respective plate portions 15, but also an unsymmetrical location of protrusions and depressions possible to obtain unsymmetrical flow.

I claim:

1. Plate heat exchanger comprising several heat transfer plates, each of which has at least one heat transfer portion which has in part at a specific distance from a plane parallel with the plate, upwardly pressed parallel ridges and, at an angle to said ridges, downwardly pressed parallel grooves, and in part intermediate plate portions, which are provided with protrusions and depressions, which are located at a distance from said plane less than said specific distance, the ridges on one side of a plate, as well as the ridges on the other side of the plate, which are formed by said grooves, together with the intermediate plate portions forming passages, each of which intersects passages formed on opposite side of the plate, the ridges and the grooves are so being arranged in two plates assembled adjacent each other in the plate heat exchanger so that ridges on one of the plates abut against ridges running parallel therewith on the other plate, wherein at least one of said intermediate plate portions, located between two parallel ridges and two parallel grooves, is provided with only two protrusions connected to each of said two grooves and only two depressions connected to each of said two ridges, and wherein each ridge and the depression connected thereto, and each groove and the protrusion connected thereto, respectively, comprises one part of a common wall, which extends from a top portion of the ridge to a bottom portion of the depression, and from a bottom portion of the groove to a top portion of the protrusion, respectively, and at least two of the walls opposite each other in the same intermediate plate portion have a height which exceeds said specific distance.

2. Plate heat exchanger according to claim 1, wherein said protrusions (18) and said depressions (19) extend along essentially the whole length of the groove and the ridge, respectively, at the intermediate plate portion (15).

3. Plate heat exchanger according to claim 1 wherein all of the walls (22) have a height which exceeds said specific distance.

4. Plate heat exchanger according to claim 1 wherein said protrusions (18) and said depressions (19) are symmetrically located in said intermediate plate portion (15).

* * * * *